US005709180A

United States Patent [19]

Spath

[11] Patent Number: 5,709,180

[45] Date of Patent: Jan. 20, 1998

[54] NARROW CAM TWO-STEP LIFTER

[75] Inventor: Mark James Spath, Spencerport, N.Y.

[73] Assignee: General Motors Corporation, Detroit, Mich.

[21] Appl. No.: 795,746

[22] Filed: Feb. 6, 1997

[51] Int. Cl.[6] ..... F01L 13/00; F01L 1/25

[52] U.S. Cl. ..... 123/90.16; 123/90.17; 123/90.5; 123/90.55

[58] Field of Search ..... 123/90.15, 90.16, 123/90.17, 90.27, 90.48, 90.5, 90.55

[56] References Cited

U.S. PATENT DOCUMENTS

| | | | |
|---|---|---|---|
| 5,193,496 | 3/1993 | Kruger | 123/90.16 |
| 5,287,830 | 2/1994 | Dopson et al. | 123/90.16 |
| 5,343,833 | 9/1994 | Shirai | 123/90.16 |
| 5,361,733 | 11/1994 | Spath et al. | 123/90.16 |
| 5,431,133 | 7/1995 | Spath et al. | 123/90.16 |
| 5,555,861 | 9/1996 | Mayr et al. | 123/90.16 |
| 5,603,294 | 2/1997 | Kawai | 123/90.16 |

FOREIGN PATENT DOCUMENTS

| | | |
|---|---|---|
| 4213856 | 10/1993 | Germany . |
| PCT/DE93/00357 | 12/1994 | WIPO . |

*Primary Examiner*—Weilun Lo
*Attorney, Agent, or Firm*—Karl F. Barr, Jr.

[57] ABSTRACT

A two-step valve lifter for actuation of a valve member in an internal combustion engine includes an outer cam follower, having a cam-engaging upper surface with a cylindrical body depending therefrom, and an inner cam follower disposed within said cylindrical body. The inner follower includes a hollow cylinder having a first diameter "D", an upper, closed end and a lower, open end. The open end is configured to receive, for disposition between the two-step valve lifter and the valve member, a lash adjusting, hydraulic element assembly. An obround follower foot, having a length "L" normal to said camshaft axis and a width "W" parallel to said camshaft axis and less than said length "L", extends from the upper, closed end of the inner follower to terminate in a cam engaging surface which is extendable through an opening in the cam engaging surface of the outer cam follower. The width "W" of the follower foot is less than the first diameter "D" of the hollow cylinder of the inner follower. In operation, the first cam is operable in a first mode to contact the cam engaging surface of the obround follower foot and in a second mode of operation the second cam is operable in a second mode of operation to contact the cam engaging surface of the outer cam follower at a location radially inwardly of the first diameter of the hollow cylinder of the inner cam follower.

7 Claims, 4 Drawing Sheets

NARROW CAM TWO-STEP LIFTER

TECHNICAL FIELD

The invention relates to valve lifters for internal combustion engines. In particular, the invention relates to direct acting, two-step valve lifters of the type used in overhead cam engines.

BACKGROUND OF THE INVENTION

Two step valve lifters are known which provide alternate lift profiles for actuating a single poppet valve of an engine cylinder to provide variable valve lift and/or timing. The lifters typically have concentric cylindrical followers which are actuated by adjacent cams of an associated camshaft. Locking means such as sliding pins disposed in one of the cylindrical followers, engage corresponding openings in the other follower to connect the followers together when operating on a first lift curve, such as the extended or high valve lift curve. When disengaged the locking mechanism allows lost motion movement of the concentric cylinders for operation on a second lift curve.

A two step lifter having concentric cylindrical followers of the type described may not find easy application in certain engines due to cam width and spacing requirements imposed on the cam shaft by the configuration or location of the cam operating surfaces of the lifter. In particular, the outer lifter cam lobes must be spaced, relative to the inner lift lobe to avoid contact with the inner follower. Traditionally, the inner follower occupies a diameter sufficient to house a hydraulic lash compensation element or assembly. The width of the resulting tri-lobe cam group may cause an interference problem with camshaft bearings located on either side of the lifter bores.

SUMMARY OF THE INVENTION

The present invention is directed to a two-step, variable valve actuation lifter for direct acting applications which minimizes cam actuator width requirements while providing adequate lift capability to execute valve and/or cylinder deactivation strategies for internal combustion engines having cylinder-head space limitations. The valve lifter disclosed herein incorporates a stepped inner lifter having an axially extending, cam engaging portion which is substantially narrower, in the direction of the camshaft axis, than an associated cylindrical portion housing the hydraulic lash compensating element. The cam engaging portion preferably includes an obround cross-section capable of providing an increased load carrying capability while operating to prevent rotation of the inner lifter relative to the outer lifter, so as to maintain the alignment of the locking mechanism. The stepped portion of the inner lifter functions as the engaging surface for the locking pins which operate, under fluid pressure, from the outer lifters. As the pins extend, they engage open saddle members having complementary surfaces which operate to reduce surface stress on the pin and lifter.

It is an object, therefore, of the present invention to provide a two step variable valve actuation lifter having a conventional hydraulic lash element wherein the cam actuator, comprising the high and low lift valve actuating cams, may be packaged in an engine having axial limitations in the direction of the camshaft axis.

DESCRIPTION OF THE PREFERRED EMBODIMENT

Figure 1:
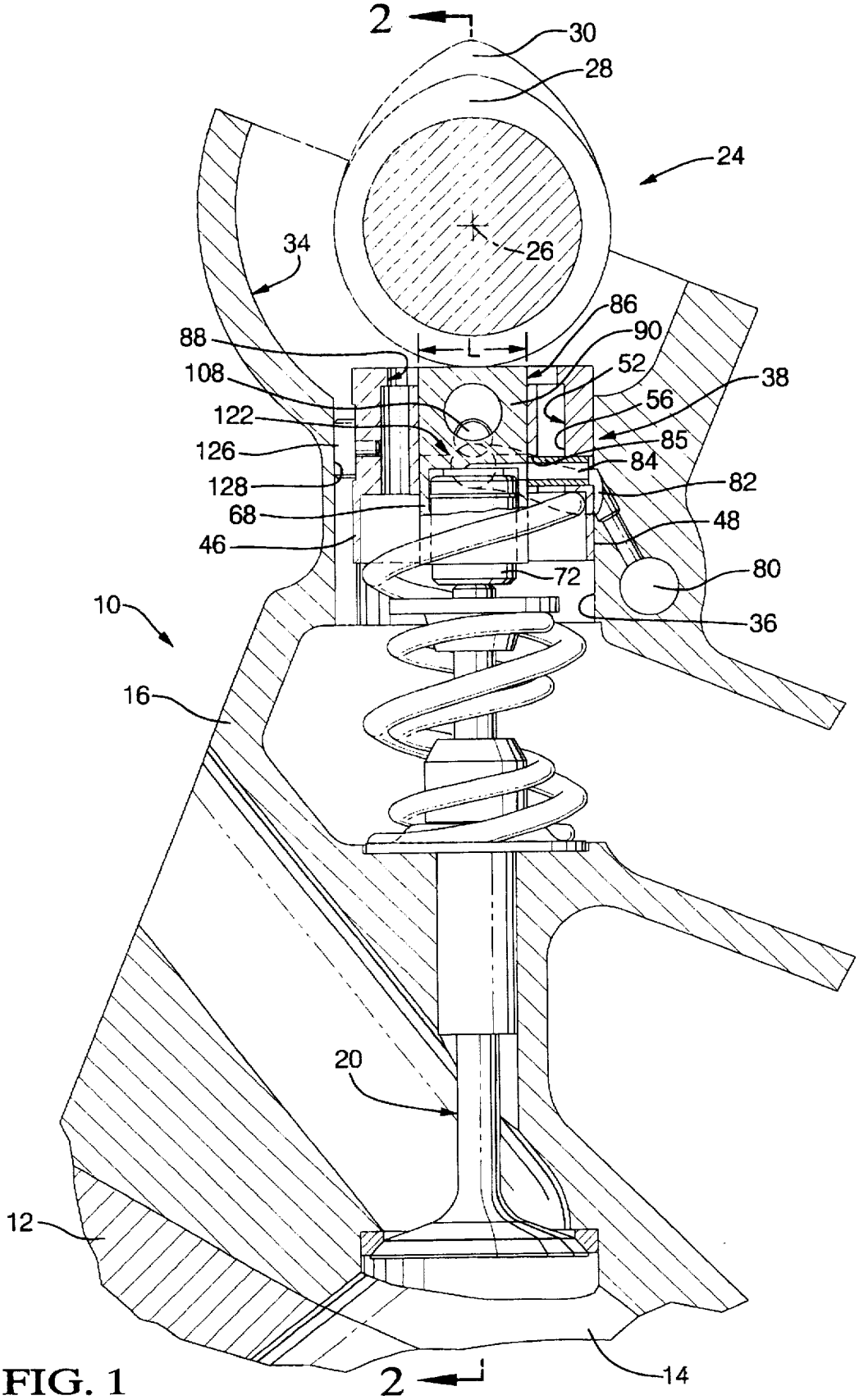
FIG. 1 is a partial, sectional view of an internal combustion engine, illustrating features of the present invention.
Figure 2:
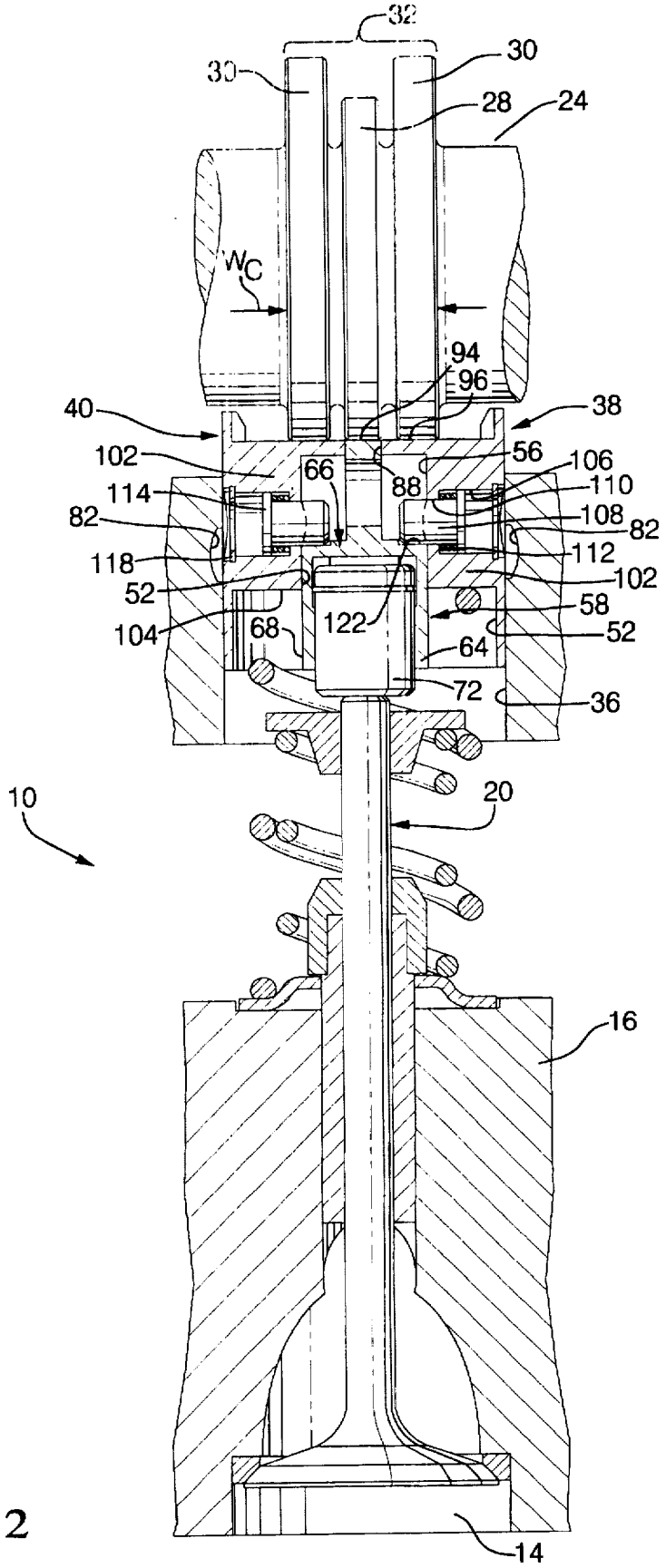
FIG. 2 is a partial, sectional view of the internal combustion engine of FIG. 1, taken along line 2—2.

Referring to the drawings, and in particular to FIGS. 1 and 2, there is shown a portion of an overhead camshaft, internal combustion engine, designated generally as 10, having a cylinder block 12 including a number of cylinders 14, one of which is shown. The block 12 supports a cylinder head 16 which closes the ends of the cylinders 14 to define combustion chambers for each cylinder. The head 16 carries inlet and exhaust valves which control the admission of combustion air and fuel to the cylinders and the discharge of exhaust constituents therefrom. While the invention disclosed herein has application to both inlet and exhaust valves, it will be described with reference to the inlet valve 20 shown in the figures.

A camshaft 24 is supported by the cylinder head 16 for rotation along a camshaft axis 26. The camshaft 24 carries a plurality of cam lobes which are located in longitudinal, spaced relationship along its axis. For each inlet valve 20 which is operated in a two-step high-low lift profile, the camshaft 24 is provided with three axially spaced cams which include a centrally located low lift cam 28 and a pair of high lift cams 30 spaced on opposite sides of the low lift cam 28. The three lobe cam group is referred to generally as 32.

Figure 5:
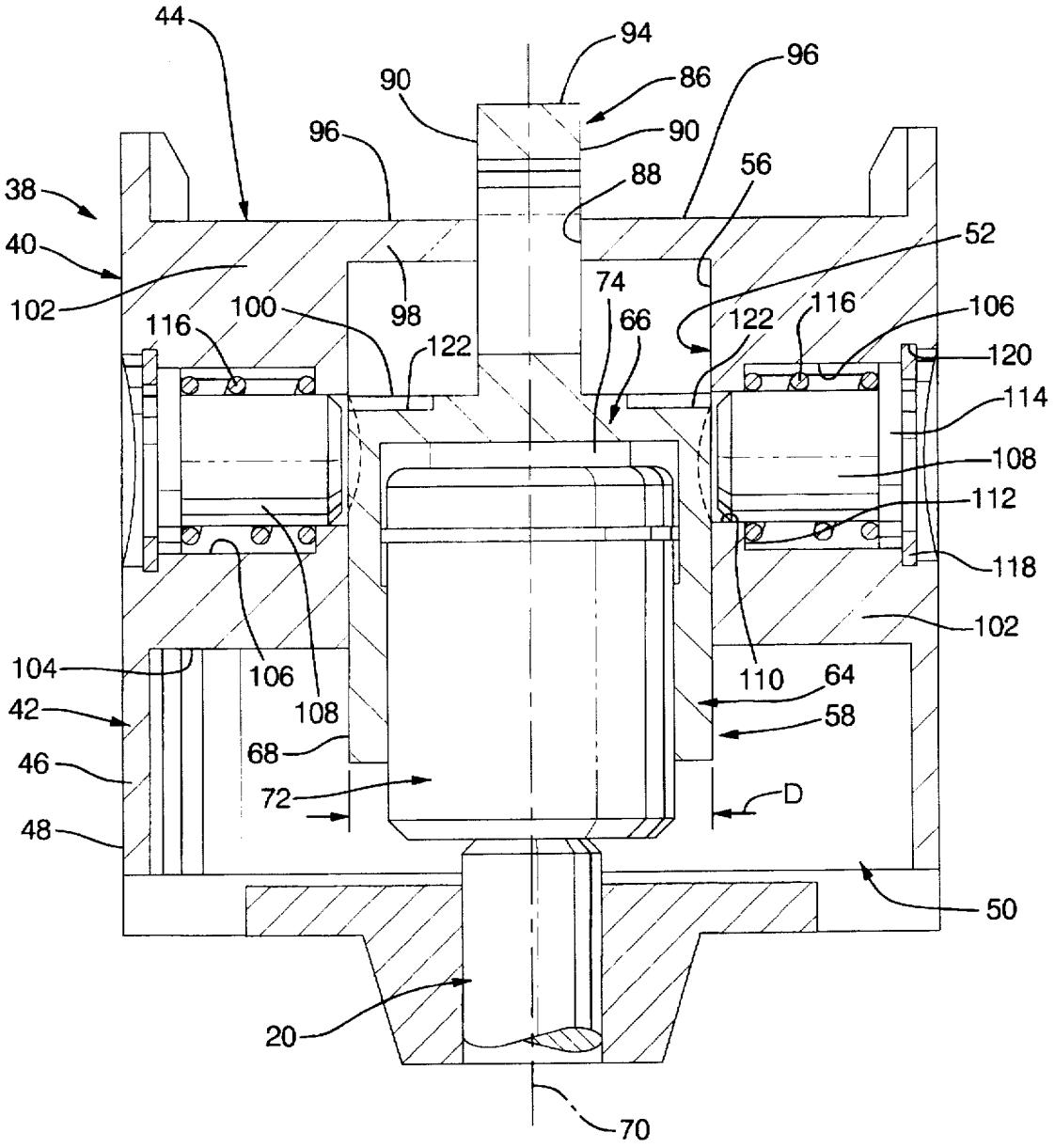
FIG. 5 is an enlarged view of a portion of FIG. 3.

A lifter gallery 34, in this case forming a part of the camshaft cylinder head 16, is provided with a plurality of lifter bores 36 which are aligned with associated cam groups 32 on camshaft 24. In accordance with the invention, a two step valve lifter 38, FIG. 5, is reciprocable in each of the lifter bores 36 and actuates an associated inlet valve 20 in a manner to be subsequently described. Each valve lifter 38 includes an outer, high-lift cam follower 40 having an annular, cylindrical body 42 with a cam engaging upper end 44, a depending cylindrical skirt 46 having a cylindrical outer surface 48 and an open lower end 50. A stepped, concentric, inner cylinder 52 extends from the lower, open end 50 of the skirt 46 to terminate adjacent the cam engaging upper end 44. The concentric inner cylinder 52 extends from a location adjacent the cam engaging upper end 44, and includes a cylindrical inner surface 56 concentric with the outer surface 48 of the skirt 46. The cylindrical inner surface 56 is configured to slidably receive an inner cam follower such as low-lift follower 58. The cylindrical inner surface 56 terminates intermediate of the ends of the body 42.

The inner follower 58 comprises a hollow cylinder 64 having a closed end 66 and a depending cylindrical wall 68. The wall 68 is received by the cylindrical inner surface 56 of the concentric inner cylinder 52 for reciprocation on a common axis 70. Within the hollow cylinder 64 there is reciprocably received a hydraulic lash adjuster or hydraulic element assembly 72. The hydraulic element assembly 72 includes a hollow piston 74 internally carrying a check valve and other elements of a conventional hydraulic element assembly, not shown. Pressurized hydraulic fluid to operate the hydraulic lash adjuster 72 may by supplied through a cylinder head oil gallery 80 which terminates in oil passage 82 extending in each lifter bore 36 such that the passage 82 is in fluid communication with a tubular supply passage 84, FIG. 1, which extends from the outer surface 48 of the skirt 46 through the cylindrical inner surface 56 of the concentric inner cylinder 52. Fluid communication between tubular supply passage 84 and the hydraulic assembly element 72 is established through an opening 85 in the inner follower cylindrical outer wall 68.

Figure 4:
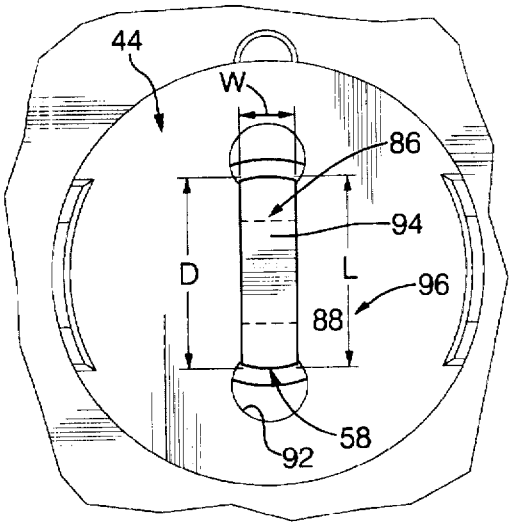
FIG. 4 is a top view of the hydraulic valve lifter defined by the present invention, taken along line 4—4 of FIG. 3.

Extending from the closed end 66 of the inner follower 64 is an axially extending inner follower foot 86. The inner follower foot 86 is preferably constructed with an obround configuration, FIG. 4, such that its length "L", normal to the camshaft axis 26 is substantially the same as that of the inner follower diameter "D", while the width "W" of the foot 86, in the direction of the camshaft axis 26 is substantially narrower than that of the inner follower diameter "D". As illustrated in FIG. 4, the width "W" of the inner follower foot 86 is preferably selected to closely resemble that of the central, low lift cam actuator 28. The low lift cam foot 86 extends upwardly, as viewed in the Figures, through a corresponding opening 88 in the cam engaging upper end 44 of the annular cylindrical body 42 of the outer cam follower 40. The opening 88 has an oblong or slotted configuration, FIG. 4, for closely receiving the parallel sides 90 of the foot 86 while the ends 92 of the opening 88 may include stress relief openings which function to vent the concentric inner cylinder 52 as the inner follower 58 reciprocates therein.

The foot 86 of the inner follower 58 includes cam engaging surface 94 for contact with the low lift cam lobe 28 during low lift engine operation. As a result of the obround configuration of the inner follower foot 58, the cam engaging surface 94 extends substantially the diameter "D" of the inner follower 58 to thereby provide a footprint which is similar to a full sized lift foot in which the upper, closed end of the inner lifter assembly contacts the cam lobe.

Spaced laterally of the opening 88 in the cam engaging upper end 44 of the body 42 are outer follower cam engaging surfaces 96 which operate with high lift cams 30 to open the valve 20 during a second phase of engine operation. The outer follower cam engaging surfaces 96 are spaced closely adjacent to the opening 88 and, thus the inner follower foot 86 and, due to the obround configuration of the inner follower foot, are located at least partially, radially within the diameter "D" of the concentric inner cylinder 52, FIG. 3. The outer follower cam engaging surfaces 96 are configured as inwardly flanged portions 98 which radially overlay the shoulders 100 of the inner follower 58 connecting the cylindrical wall 68 of hollow cylinder 64, with the axially extending inner follower foot 86. As illustrated in FIG. 2, the three lobe cam group 32, by virtue of the radial inward location of the outer high lift cams 30 facilitated by the obround configuration of the inner follower foot 86, is capable of an axial dimension "$W_c$" which is significantly less than the diameter of the cylindrical follower body 42. In engine applications in which camshaft bearing spacing overlaps the lifter bores 36, the narrow configuration of the camshaft cam lobe group 32, brought about through the use of the obround inner lifter foot configuration, allows for the application of variable valve lift.

Figure 3:
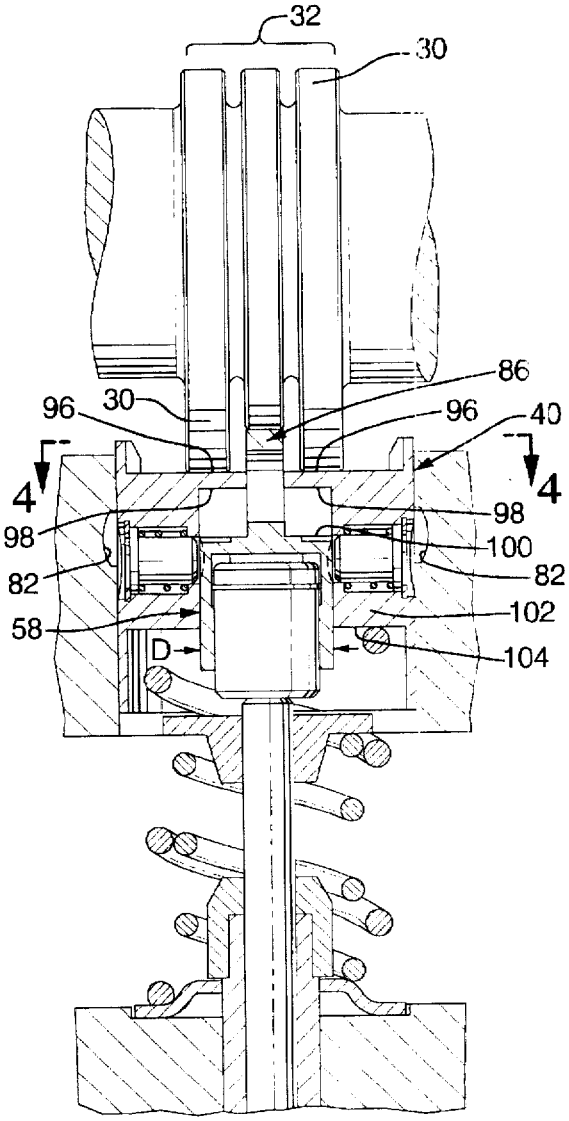
FIG. 3 shows the partial, sectional view of FIG. 2 in an alternate mode of operation.

Extending between the cylindrical skirt 46 of the follower body 42 and the concentric inner cylinder 52 are webs 102. The webs 102 extend from the upper, closed end 44 of the follower body 42 to a location intermediate the closed end and the open end 50 where the web terminates in shoulders 104. A through bore 106 extends radially through each web 102 from the outer surface 48 of the cylindrical skirt 46 to the cylindrical inner surface 56 of the concentric inner cylinder 52. Each through bore 106 is configured for sliding receipt of a hydraulically actuated locking pin 108 which, when subjected to hydraulic pressure is movable, radially inwardly, to lock the inner follower 58, relative to the outer follower 40, initiating high lift operation of the two-step valve lifter 38 on the high lift cams 30. Hydraulic pressure to actuate the locking pins 108 may be supplied through cylinder head oil gallery 80 and oil passage 82 which are in fluid communication with through bores 106. The through bores 106 have a portion of reduced diameter 110 adjacent the cylindrical inner surface 56 of the concentric inner cylinder 52 which portions define a stop flange 112 for limiting the radial inward movement of the locking pins 108 through engagement with a corresponding stop shoulder 114 extending about the circumference of each pin 108. In addition, the stop flange 112 and the stop shoulder 114 define inner and outer spring seats, respectively, for locating a locking pin return spring 116. A circular clip 118, disposed in circumferential groove 120 in each through bore 106, prevents radial outward movement of the locking pins 108 from the lifter body 42 which could result in contact with the lifter bores 36 in the cylinder head 16. Hydraulic oil pressure required to actuate the locking pins are introduced to the cylinder head oil gallery 80 through a suitable controller (not shown). During engine operation, the oil pressure supplied to the lifters 38 by the controller is normally modulated to a low level which is sufficient for operation of the hydraulic element assembly 72 but insufficient to overcome the return force of the locking pin return springs 116. This condition allows the outer and inner followers, 40 and 58 respectively, to follow their respective cam lobes independently, as illustrated in FIG. 3, so that valve motion is defined by the profile of the central, low lift cam lobe 28 operating on the inner follower 58 with the outer follower 40 assuming a lost-motion function. When oil pressure to the gallery 80 is increased by the controller, the locking pins 108 move radially inwardly, against the outward bias of return springs 116 to engage the inner follower 58. When moved to the locked position, FIG. 2, the locking pins engage seating surfaces 122 formed in the shoulder 100. During the base circle portion of the lift event, the locking pins 108 align with the seating surfaces 122 of the inner follower 58 and extend into and engage with the seats 122 such that, on subsequent lift event the pins will effectively lock the inner and outer followers 58 and 40 with valve movement defined by the outer high lift cam lobes 30. The complementary cylindrical shape of the locking pins 108 and the seating surfaces 122 assures that contact stresses are evenly distributed over the seat surface rather than limited to a single line of contact therebetween. Such a stress distribution reduces wear on the low lift follower shoulder 100. Following release of hydraulic pressure, pin return springs 116 operate to move the locking pins 108 radially outwardly to unlock the inner cam follower 58 from the outer cam follower 40 to re-initiate low lift actuation of the poppet valve.

Rotation of the outer follower body 42 with the lifter bore 36 of the lifter gallery 34 is controlled by an antirotation pin 126 which is disposed in a pin slot 128 formed in the lifter bore 36.

The present invention is directed to a variable valve actuation lifter for direct-acting applications which substantially reduces required cam lobe width while providing adequate lift capability to execute valve and/or cylinder deactivation strategies in engines having space limitations. The lifter features a stepped inner lifter having a follower foot with an obround configuration or foot print which defines adequate inner lifter contact area while facilitating closely adjacent operation of the outer lifter cams on the outer lifter. In the preferred embodiment described herein, the outer cams operate partially within the diameter of the cylindrical inner follower, substantially reducing the axial width of the three lobe cam group.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described were chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

I claim:

1. A two-step valve lifter operable in response to first and second rotatable cams on a camshaft, defining a camshaft axis, to actuate a valve member in an internal combustion engine comprising an outer cam follower, having a cam-engaging upper surface with a cylindrical body depending therefrom, and an inner cam follower disposed within said cylindrical body, said inner follower including a hollow cylinder having a first diameter "D" and including an upper, closed end and a lower, open end, said open end configured to receive, for disposition between said two-step valve lifter and the valve member, a lash adjusting, hydraulic element assembly therein, a follower foot, having a length "L" normal to said camshaft axis and a width "W" parallel to said camshaft axis and less than said length "L", extending from said upper, closed end and terminating in a cam engaging surface extendable through an opening in said cam engaging surface of said outer cam follower, said follower foot width "W" less than said first diameter "D" of said hollow cylinder of said inner cam follower, said first cam operable in a first mode of operation of said two-step valve lifter to contact said cam engaging surface of said follower foot, and said second cam operable in a second mode of operation of said two-step valve lifter to contact said cam engaging surface of said outer cam follower radially inwardly of said first diameter of said hollow cylinder of said inner cam follower.

2. A two step valve lifter, as defined in claim 1, said follower foot having an obround configuration wherein said length "L" is substantially equal to said diameter "D" of said hollow cylinder of said inner cam follower.

3. A two step valve lifter, as defined in claim 2, said follower foot having an obround configuration wherein said width "W" is defined by the width of said first rotatable cam along said camshaft axis.

4. A two-step valve lifter, as defined in claim 1, said follower foot and said closed end of said hollow cylinder of said inner cam follower operable to define radially inwardly extending shoulders including seating surfaces for engaging with hydraulically actuated cylindrical locking pins disposed in said cylindrical body of said outer cam follower, said locking pins retracted in said first mode of operation of said two-step valve lifter to allow relative movement of said inner cam follower relative to said outer cam follower and extendable in said second mode of operation of said two-step valve lifter to seat said locking pins on said seating surfaces to thereby fix said outer cam follower to said inner cam follower.

5. A two-step valve lifter, as defined in claim 4, said seating surfaces including a cylindrical configuration complementary to said cylindrical locking pins wherein contact stress between said locking pins and said seating surfaces is distributed over said seating surface.

6. A two step valve lifter, as defined in claim 3, said opening in said cam engaging surface of said outer follower including an obround configuration including stress relief openings operable to vent said cylindrical body of said outer cam follower upon movement of said inner cam follower.

7. A two-step valve lifter operable in response to first and second rotatable cams on a camshaft, defining a camshaft axis, to actuate a valve member in an internal combustion engine comprising an outer cam follower, having a cam-engaging upper surface with a cylindrical body depending therefrom, and an inner cam follower disposed within said cylindrical body, said inner follower including a hollow cylinder having a first diameter "D" and including an upper, closed end and a lower, open end, said open end configured to receive, for disposition between said two-step valve lifter and the valve member, a lash adjusting, hydraulic element assembly therein, an obround follower foot, having a length "L" normal to said camshaft axis and a width "W" parallel to said camshaft axis and less than said length "L", extending from said upper, closed end and terminating in a cam engaging surface extendable through an opening in said cam engaging surface of said outer cam follower, said follower foot width "W" less than said first diameter "D" of said hollow cylinder of said inner cam follower, said first cam operable in a first mode of operation of said two-step valve lifter to contact said cam engaging surface of said obround follower foot, and said second cam operable in a second mode of operation of said two-step valve lifter to contact said cam engaging surface of said outer cam follower radially inwardly of said first diameter of said hollow cylinder of said inner cam follower.

* * * * *